US007584736B2

(12) United States Patent
Li et al.

(10) Patent No.: US 7,584,736 B2
(45) Date of Patent: Sep. 8, 2009

(54) LUBRICATION DEVICE OF FOUR-STROKE ENGINES

(75) Inventors: Shao-Yu Li, Hsinchu (TW); Yeu-Jou Lin, Hsinchu (TW); Huan-Lung Gu, Hsinchu (TW); Chi-Wei Chang, Hsinchu (TW)

(73) Assignee: Industrial Technology Research Institue, Hsinchu Hsien (TW)

( * ) Notice: Subject to any disclaimer, the term of this patent is extended or adjusted under 35 U.S.C. 154(b) by 0 days.

(21) Appl. No.: 12/255,487

(22) Filed: Oct. 21, 2008

(65) Prior Publication Data

US 2009/0090327 A1 Apr. 9, 2009

Related U.S. Application Data

(63) Continuation-in-part of application No. 12/068,094, filed on Feb. 1, 2008, now Pat. No. 7,481,197.

(30) Foreign Application Priority Data

Oct. 3, 2007 (TW) ..... 96137017 A

(51) Int. Cl.
*F01M 1/02* (2006.01)
*F01M 9/10* (2006.01)
*F01M 11/02* (2006.01)

(52) U.S. Cl. ..... 123/196 R; 123/196 CP

(58) Field of Classification Search ..... 123/196 R, 123/196 CP; 92/153; 210/153
See application file for complete search history.

(56) References Cited

U.S. PATENT DOCUMENTS

| | | | | |
|---|---|---|---|---|
| 5,964,198 | A * | 10/1999 | Wu | 123/196 R |
| 6,170,456 | B1 * | 1/2001 | Gu et al. | 123/196 S |
| 6,213,078 | B1 * | 4/2001 | Ryu et al. | 123/196 R |
| 6,378,396 | B1 * | 4/2002 | Reinhardt et al. | 74/595 |
| 6,622,688 | B2 * | 9/2003 | Everts et al. | 123/195 R |
| 6,631,701 | B2 * | 10/2003 | Seader et al. | 123/90.34 |
| 6,644,263 | B2 * | 11/2003 | Hare | 123/196 R |
| 6,772,726 | B2 * | 8/2004 | Kawamoto et al. | 123/196 W |
| 6,810,849 | B1 * | 11/2004 | Hirsch et al. | 123/185.3 |
| 7,363,904 | B2 * | 4/2008 | Utsumi et al. | 123/196 R |

* cited by examiner

*Primary Examiner*—Stephen K Cronin
*Assistant Examiner*—David Hamaoui
(74) *Attorney, Agent, or Firm*—Birch, Stewart, Kolasch & Birch, LLP

(57) ABSTRACT

A lubricant device of four-stroke engine is provided according to the present invention. The lubricant device is applicable to a four-stroke engine having a cylinder, a crank case, a rocker arm room and a cam room connected to the rocker arm room. The lubricant device mainly has the rocker arm room and the crank case be connected to each other, and the design of alternating oil supply and oil recycling channels enables lubricant mists to cycle from the crank case through the rocker arm room to the cam room, and then be re-absorbed into the crank case, thereby allowing engines to be manipulated at various angles.

30 Claims, 15 Drawing Sheets

LUBRICATION DEVICE OF FOUR-STROKE ENGINES

This application is a Continuation-In-Part of co-pending application Ser. No. 12/068,094 filed on Feb. 1, 2008, and for which priority is claimed under 35 U.S.C. § 120. This application claims priority under 35 U.S.C. § 119(a) on Patent Application No. 096137017 filed in Taiwan on Oct. 3, 2007, the entire contents of each application being incorporated by reference.

BACKGROUND OF THE INVENTION

1. Field of the Invention

This invention generally relates to four-stroke engines, and more specifically, to a lubrication device that is applicable to four-stroke engines.

2. Description of Related Art

In order to provide common portable work machines, such as lawn mowers, chain saws, and other trimmers with sufficient torque and long-term power, modern industry adopts designs that employ engines of internal combustion as power source. However, the foresaid portable work machines are commonly manipulated at various angles, for instance, a chain saw must be manipulated at various angles in accordance with a specific practical object to be cut, but not maintaining at a same angle; beside, to respond to the demands of manually manipulating light weight and high rotation speed, two-stroke engines are preferable selections of internal combustion engine to four-stroke engines theoretically.

When a foresaid two-stroke engine is operating, it emits exhaust fume and takes in air at the same time; in this situation, the emitted exhaust fume contains some fuel unburned or incompletely burned, such that that using the two-stroke engine will cause exhaust fume pollution, thereby not able to conform to some of the recently issued standards and regulations of pollution emissions. On the contrary, since four-stroke engines have fuel combusted more completely, they conform to the emission standards, Further, four-stroke engines produce less noise than the two-stroke engines during operation therefore it is an inevitable trend to adopt four-stroke engines in the designs of power work machines.

Although four-stroke engines have the advantages of less noise and lower emission pollution, they have disadvantage of requiring proper lubrication on cams and valves of the four-stroke engines, and therefore, a four-stroke engine must be integrated with a lubrication device. However, when a four-stroke engine integrated with a lubrication device is applied to a work machine, such as portable work machines like chain saws, due to the practical application environment, an user is likely to manipulate the four-stroke engine at an extremely slanting or even upside down angle, and at this moment, lubricant stored inside the crank case of the lubrication device is likely to flow into exhaust valves and possibly the flow path of air mixture in the combustion air as well, thereby interfering with effective air combustion and causing engine oil leakage.

In order to overcome the current drawbacks of four-stroke engines applied to portable work machines, some improved designs of lubrication device of four-stroke engines are provided according to U.S. patents, for instance, U.S. Pat. No. 6,213,078, and U.S. Pat. No. 6,170,456, and others.

As shown in FIGS. 1A and 1B, a lubrication device of four-stroke engines is disclosed in U.S. Pat. No. 6,213,078, wherein an oil hole 11 connected to a lubricant tank 12 is disposed underneath a cam room 10, and the lubricant recycles back to the lubricant tank 12 via the oil hole 11.

Manipulations of this kind of design at some sloping angles are likely to cause the lubricant to directly reflow to the valve via the cam room 10, and then flow out of the engine via a breathing pipe between valve chamber and air filter.

As shown in FIG. 2, U.S. Pat. No. 6,170,456 discloses a lubrication device of four-stroke engines, which mainly dispose a stirring chamber 14 located on a long and narrow concave underneath the crank case 13, and forms an oil hole 15 at a bottom of the stirring chamber 14 connected to an engine oil tank. Although this kind of design is capable of preventing massive lubricant from flowing into the crank case when the engine is at a slanting angle, it is not capable of providing other mechanical parts of machine, such as cam and gas valves and others, with effective lubrication when the engine is operationally turning over for a long time period. In addition, the traditional breathing pipe that is externally connected to air filter generally is lacks any filtering design, therefore, when the engine is operating at a slanting angle, the lubricant is likely to flow out via the breathing pipe, thereby causing problems of unnecessary lubricant consumption and air filter contamination.

Hence, it is a highly urgent issue in the industry for how to provide a lubrication device of four-stroke engines, which is capable of enabling lubricant to flow into valve chamber and cam room to provide effective lubrication, and meanwhile preventing massive lubricant from flowing into air-intake system to cause engine extinguishment, thereby allowing the user to manipulate engine at various angles.

SUMMARY OF THE INVENTION

In view of the foregoing drawbacks of the prior art, it is therefore an object of the present invention to provide a lubrication device of four-stroke engines, which enables four-stroke engines to be manipulated at various angles.

It is another object of the present invention to provide a lubrication device of four-stroke engines, which is capable of providing proper lubrication, thereby avoiding engine piston jammed in cylinder due to insufficient lubrication and wearing of valve.

It is a further object of the present invention to provide a lubrication device of four-stroke engines, which is capable of avoiding problems of lubricant consumption as well as air filter contamination caused by massive lubricant flowing out from breathing pipe.

In order to attain the above and other objectives, the present invention provides a lubrication device of four-stroke engines, comprising: a lubricant tank connected to an underneath crank case of the engine, for containing lubricant; a stirring chamber disposed underneath the crank case and partially disposed inside the lubricant tank, and having at least one oil hole connected to the lubricant tank; an oil stirring rod disposed at one end of piston connecting rod of the engine and is received in the stirring chamber, for stirring lubricant to form oil mists; an oil supply path comprising a pipeline connected to a rocker arm room and the crank case of the engine, and an oil supply channel disposed inside a crankshaft first section of the crank case and correspondingly connected to the pipeline and interior of the crank case, and when the crankshaft first section rotates to a first rotation angle, the oil supply channel opens to supply the oil mists through the rocker arm room to the cam room of the engine; and an oil recycling path having an oil recycling channel disposed inside the crankshaft second section and correspondingly connected to the interiors of the cam room and the crank case, and when the crankshaft second section rotates to a second rotation angle, the oil recycling channel opens to re-absorb the oil mists into the crank case.

In the foresaid lubrication device of four-stroke engines, the stirring chamber can have a long and narrow concave located inside the lubricant tank, wherein each of the oil holes is at least disposed on two sides and bottom end of the long and narrow concave, but not limited thereto, and each of the oil holes can further be disposed on the bottom end of the stirring chamber nearby two sides of the long and narrow concave. In addition, the basic condition of the first rotation angle and the second rotation angle is that they alternate to each other, without specific limitations, and in one embodiment, the first rotation angle and the second rotation angle alternate to each other at an angle of 180 degrees.

In one embodiment, the oil supply channel may comprises a first axial aperture connected to the interior of the crank case, and a first radial aperture connected to the first axial aperture and the pipeline. The oil supply channel may further comprises a first eccentric aperture connected to the first axial aperture and the interior of the crank case, and a first airtight oil plug is disposed at an axle center of the crankshaft first section corresponding to a rim of the first eccentric aperture. A first obstruction block, for instance, in the form of a half circular ring may be disposed on an external side of the crankshaft first section corresponding to the first radial aperture, and is for covering area beyond the first rotation angle.

Naturally, the oil recycling channel can be accordingly designed, and comprises a second axial aperture and a second radial aperture connected to the second axial aperture and the cam room. The oil recycling channel may further comprise a second eccentric aperture connected to the second axial aperture and the interior of the crank case, and a second airtight oil plug disposed at an axle center of the crankshaft second section corresponding to a rim of the second eccentric aperture. A second obstruction block, for instance, in the form of a half circular ring can be disposed on the crankshaft second section corresponding to the second radial aperture, is for covering area beyond the second rotation angle.

In another embodiment, the oil supply channel may comprise a first slanting aperture having a first end and a second end, the first end is connected to the pipeline and the second end is connected to the interior of the crank case. The oil supply channel may further comprise a first eccentric aperture connected to the second end and the interior of the crank case, and a first airtight oil plug is disposed at an axle center of the crankshaft first section corresponding to a rim of the first eccentric aperture. Further, a first obstruction block, for instance, in the form of a half circular ring, may be disposed on an external side of the crankshaft first section corresponding to the first end, and is for covering area beyond the first rotation angle.

Similarly, the oil recycling channel can also be accordingly designed and comprises a second slanting aperture having a first end and a second end, the first end is connected to the cam room and the second end is connected to the interior of the crank case. The oil recycling channel further comprises a second eccentric aperture connected to the second end and the interior of the crank case, and a second airtight oil plug is disposed at an axle center of the crankshaft second section corresponding to a rim of the second eccentric aperture. In addition, a second obstruction block, for instance, in the form of a half circular ring is disposed on an external side of the crankshaft second section corresponding to the first end, and is for covering area beyond the second rotation angle.

To attain the foresaid objects, the present invention further provides a lubrication device of four-stroke engines, which is applicable to four-stroke engines that have a cylinder, a crank case, a rocker arm room connected to a cam room, and a breathing pipe. The crank case has a crankshaft that is divided into a crankshaft first section, a connection part, and a crankshaft second section. The cylinder has a piston connecting rod therein, and the piston connecting rod is connected to the connection part. The cam room is disposed with cam having a camshaft. The lubrication device comprises: a lubricant tank connected to underneath the crank case, for containing lubricant; a stirring chamber disposed underneath the crank case and partially disposed inside the lubricant tank, has and having at least one oil hole connected to the lubricant tank; an oil stirring rod disposed at one end of the piston connecting rod and is set inside the stirring chamber, for stirring lubricant to oil mists; an oil supply path comprising a pipeline connected to the rocker arm room and the crank case, and an oil supply channel disposed inside the crankshaft first section correspondingly connected to the pipeline and the interior of the crank case, and when the crankshaft first section rotates to a first rotation angle, the oil supply channel opens to supply the oil mists through the rocker arm room to the cam room; an oil recycling path comprising an oil recycling channel disposed on the crankshaft second section correspondingly connected to the interiors of the cam room and the crank case, and when the crankshaft second section rotates to a second rotation angle, the oil recycling channel opens to re-absorb oil mists into the crank case; and an exhaust channel comprising a third axial aperture disposed on the camshaft and connected to the breathing pipe, and a third radial aperture connected to the third axial aperture and the cam room.

To attain the foresaid objectives, the present invention further provides a lubrication device of four-stroke engines, which is applicable to four-stroke engines that have a cylinder, a crank case, a rocker arm room connected to a cam room, and a breathing pipe. The crank case has a crankshaft that is divided into a crankshaft first section, a connection part, and a crankshaft second section. The cylinder has a piston connecting rod therein, and the piston connecting rod is connected to the connection part. The lubrication device comprises: a lubricant tank connected to the underneath of the crank case, for containing lubricant; a stirring chamber disposed underneath the crank case and partially disposed inside the lubricant tank, and having at least one oil hole connected to the lubricant tank; an oil stirring rod disposed at one end of the piston connecting rod and is set inside the stirring chamber, for stirring lubricant to oil mists; an oil supply path comprising a pipeline connected to the rocker arm room and the crank case, and an oil supply channel located inside the crankshaft first section correspondingly connected to the pipeline and the interior of the crank case, and when the crankshaft first section rotates to a first rotation angle, the oil supply channel opens to supply the oil mists through the rocker arm room to the cam room; an oil recycling path comprising an oil recycling channel disposed on the crankshaft second section correspondingly connected to the interiors of the cam room and the crank case, and when the crankshaft second section rotates to a second rotation angle, the oil recycling channel opens to re-absorb oil mists into the crank case, wherein the breathing pipe is connected to the space in the four-stroke engine, and the space can be a channel between the cylinder and the crank case.

Further, the design of the stirring chamber in the foresaid embodiments can be omitted. That is, the lubricant tank is connected to underneath the crank case for containing lubricant, and the oil stirring rod is disposed at one end of the piston connecting rod corresponding to the stirring chamber, for stirring lubricant to oil mists.

In view of the above, the lubrication device of four-stroke engine of the present invention mainly has a rocker arm room and a crank case connect to each other, and the alternating design of the oil supply and oil-absorption channels enables lubricant mists to cycle from the crank case through the rocker arm room to cam room, and then to be re-absorbed into the crank case, thereby allowing engine to be manipulated at various angles. Moreover, the design of the oil supply path and the oil recycling path provides proper lubrication, and in accordance with the design of eccentric apertures and airtight oil plugs, situation of excess lubricant flowing out of the crank case can be avoided, thereby avoiding consequent problems of excessive wearing of the valves and engine piston jammed in cylinder caused by insufficient lubrication. In addition, the design of the exhaust channel employs centrifugal force to prevent oil drops or massive oil mists from entering, thereby avoiding problems of lubricant consumption and air filter contamination caused by massive lubricant flowing out through the breathing pipe.

BRIEF DESCRIPTION OF DRAWINGS

The present invention can be more fully understood by reading the following detailed description of the preferred embodiments, with reference made to the accompanying drawings, wherein.

DETAILED DESCRIPTION OF PREFERRED EMBODIMENTS

Figure 1A:
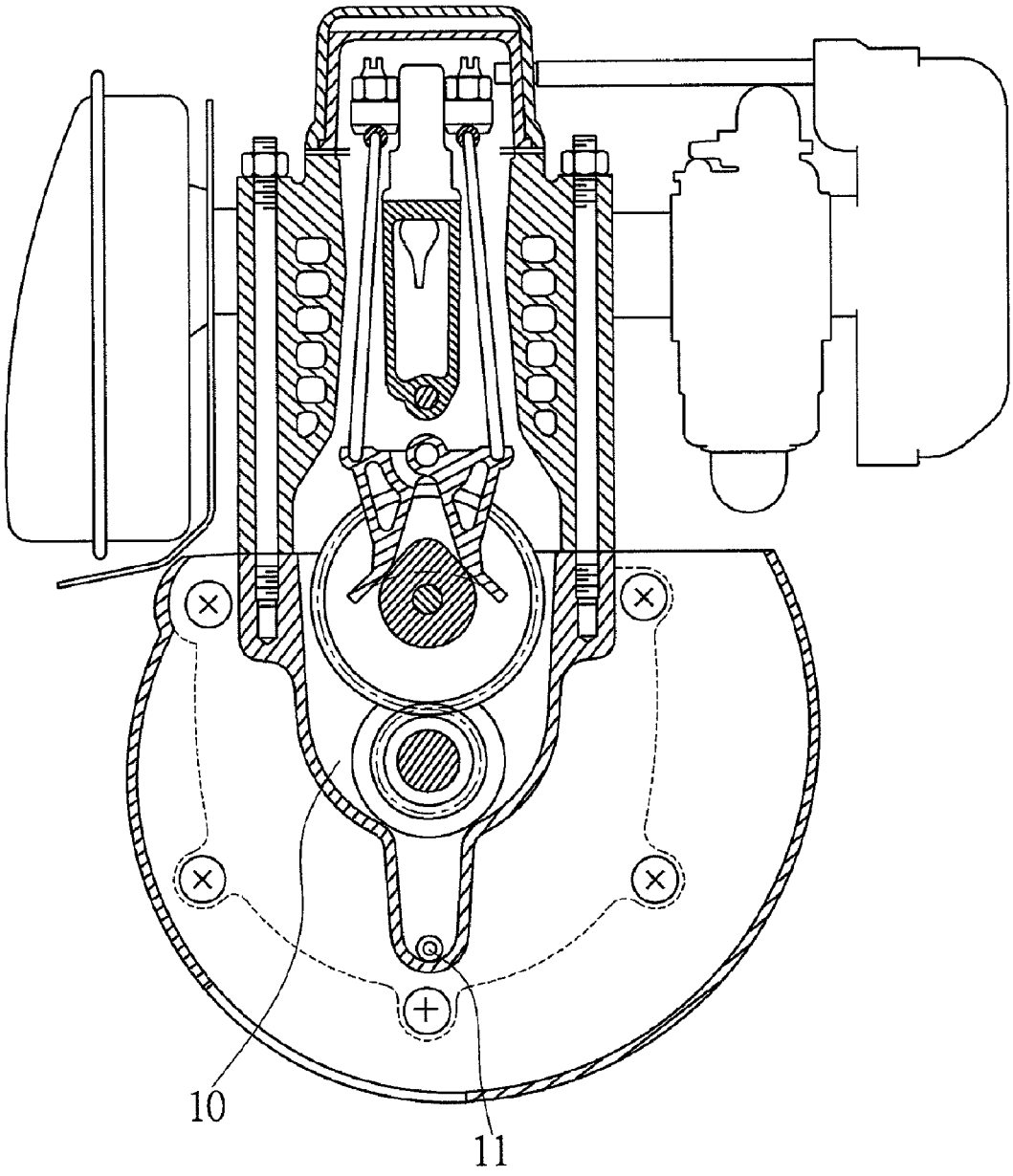
FIG. 1A (PRIOR ART)
FIGS. 1A and 1B are a top view and a side view of a lubrication device of four-stroke engines according to U.S. Pat. No. 6,213,078, respectively.
Figure 1B:
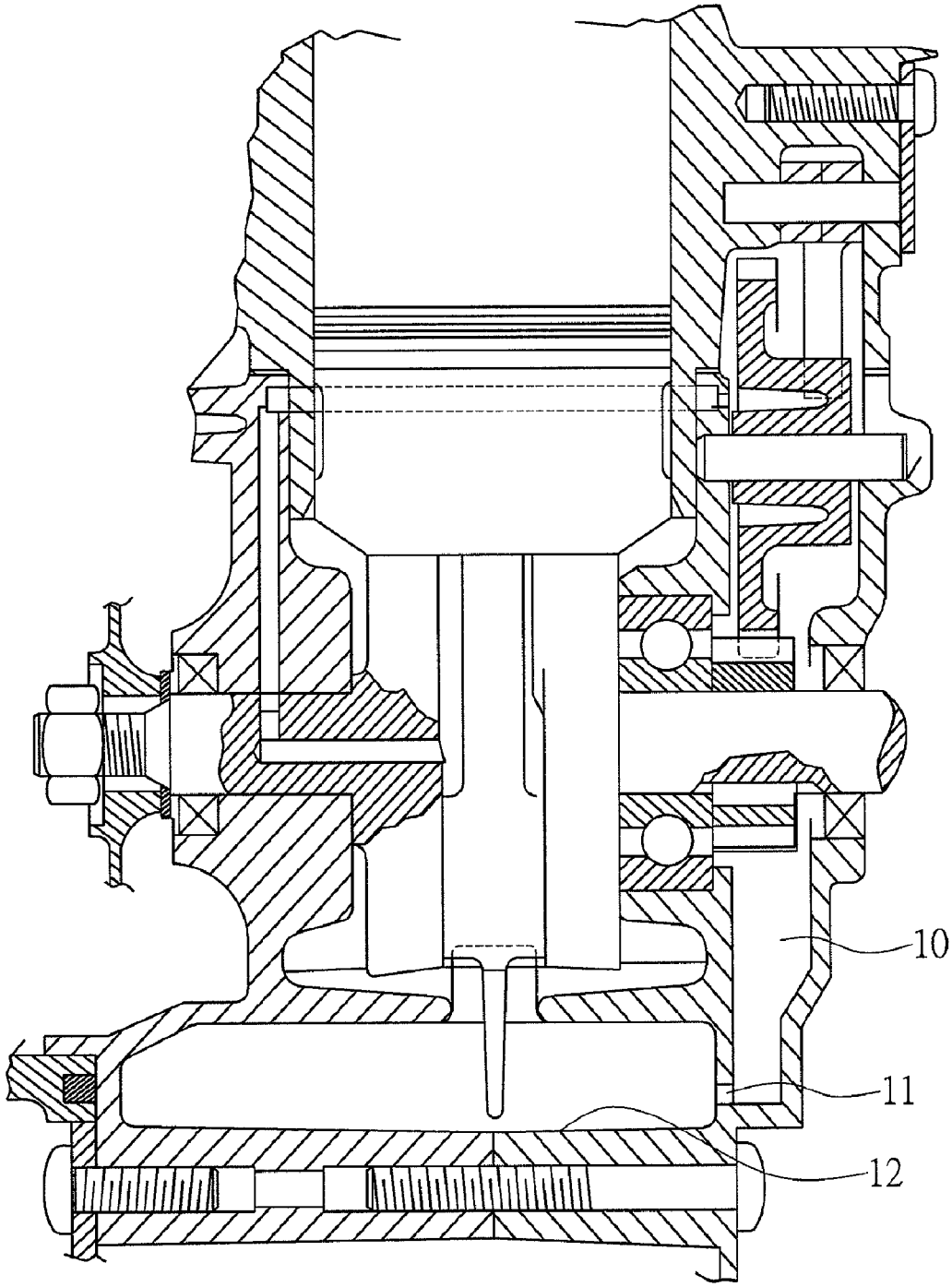
FIG. 1B (PRIOR ART)
Figure 2:
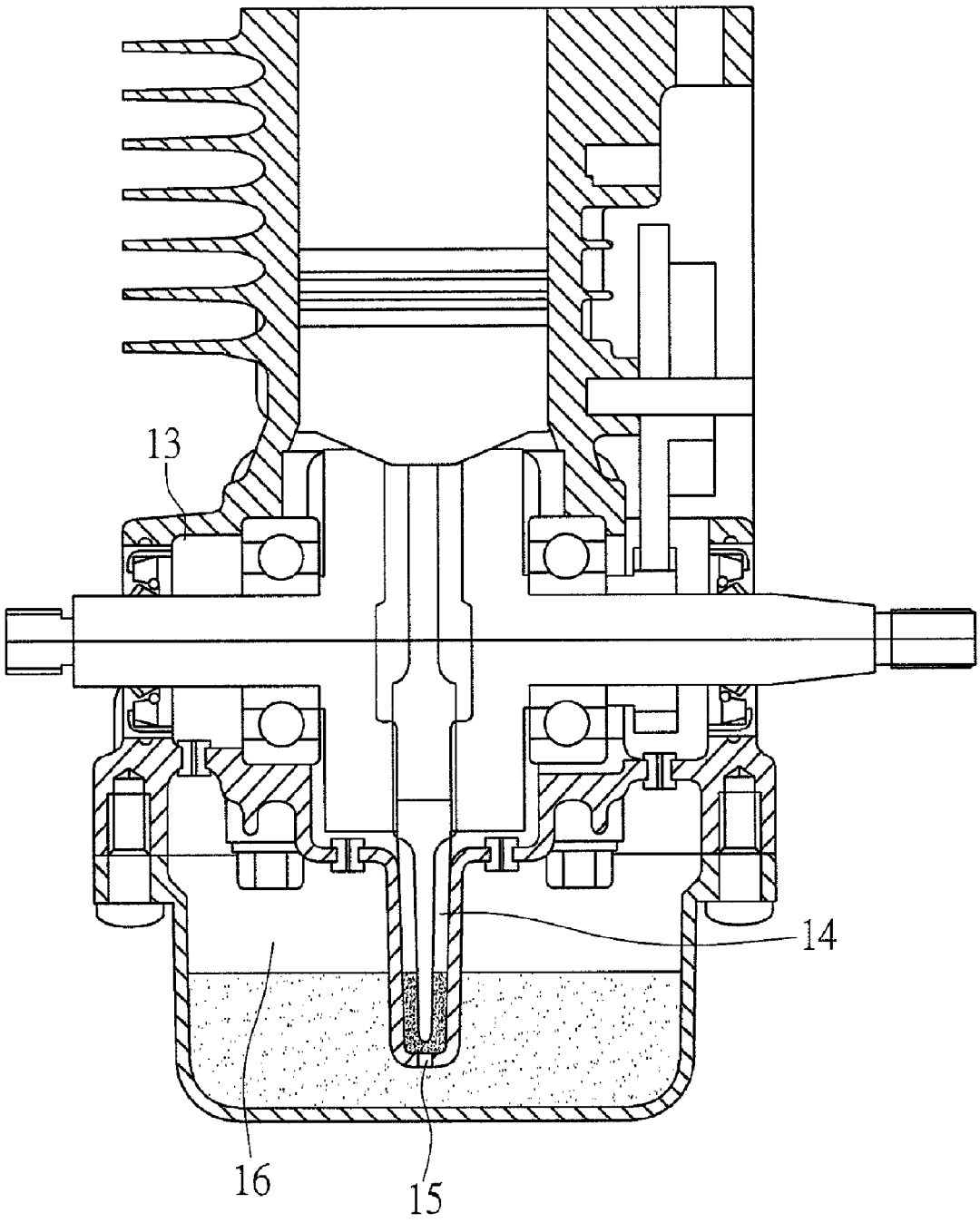
FIG. 2 (PRIOR ART)
FIG. 2 is a top view of a lubrication device of four-stroke engines according to claims of U.S. Pat. No. 6,170,456.

Embodiments of a multi-chip semiconductor device having leads and a method for fabricating the same proposed in the present invention are described as follows with reference to FIGS. 3 to 7. It should be understood that the drawing is a simplified schematic diagram only showing the components relevant to the present invention, and the layout of components could be more complicated in practical implementation.

Figure 3A:
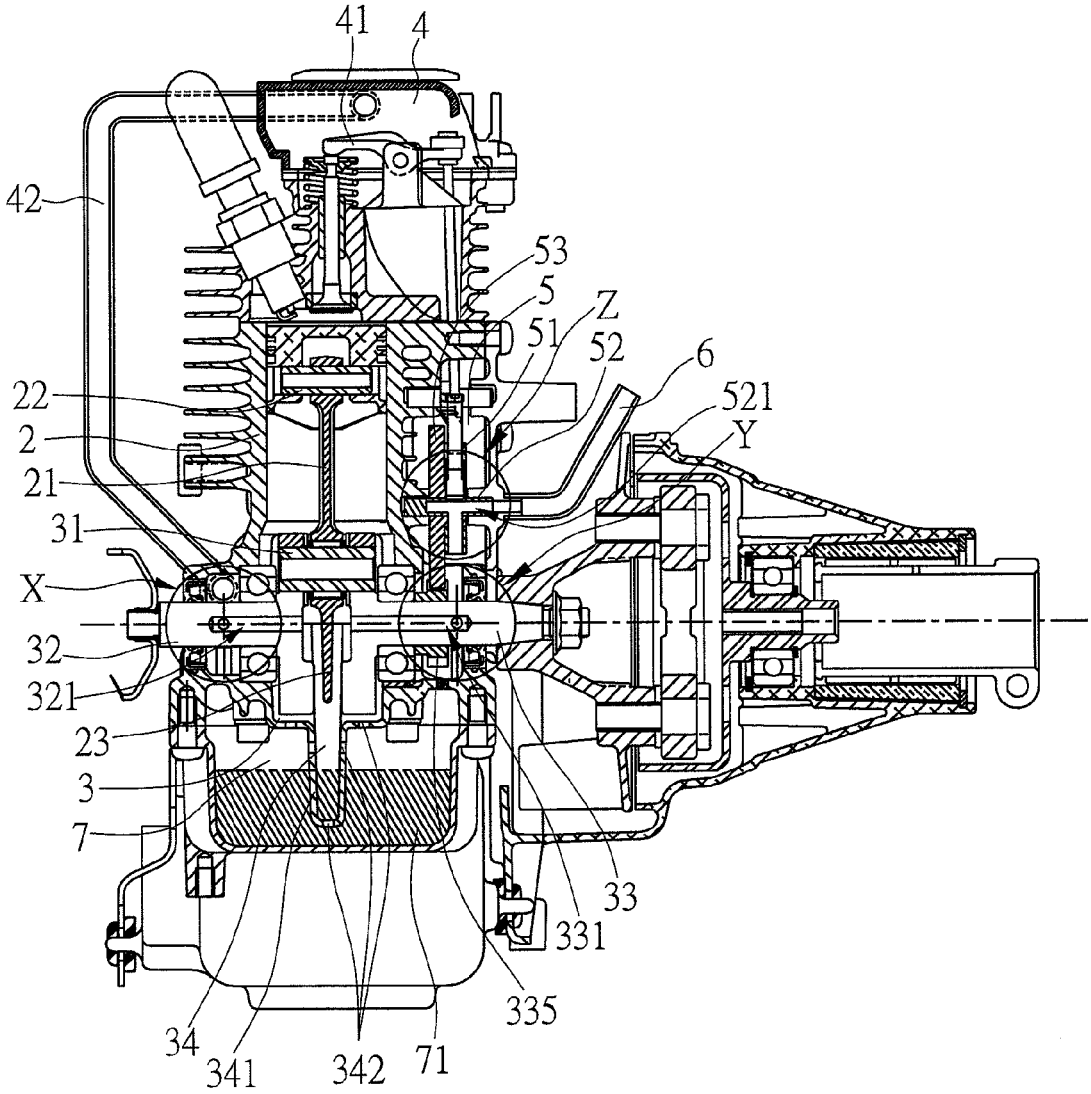
FIGS. 3A and 3B are a top view and a side view of a lubrication device of four-stroke engines of the present invention, respectively.
Figure 3B:
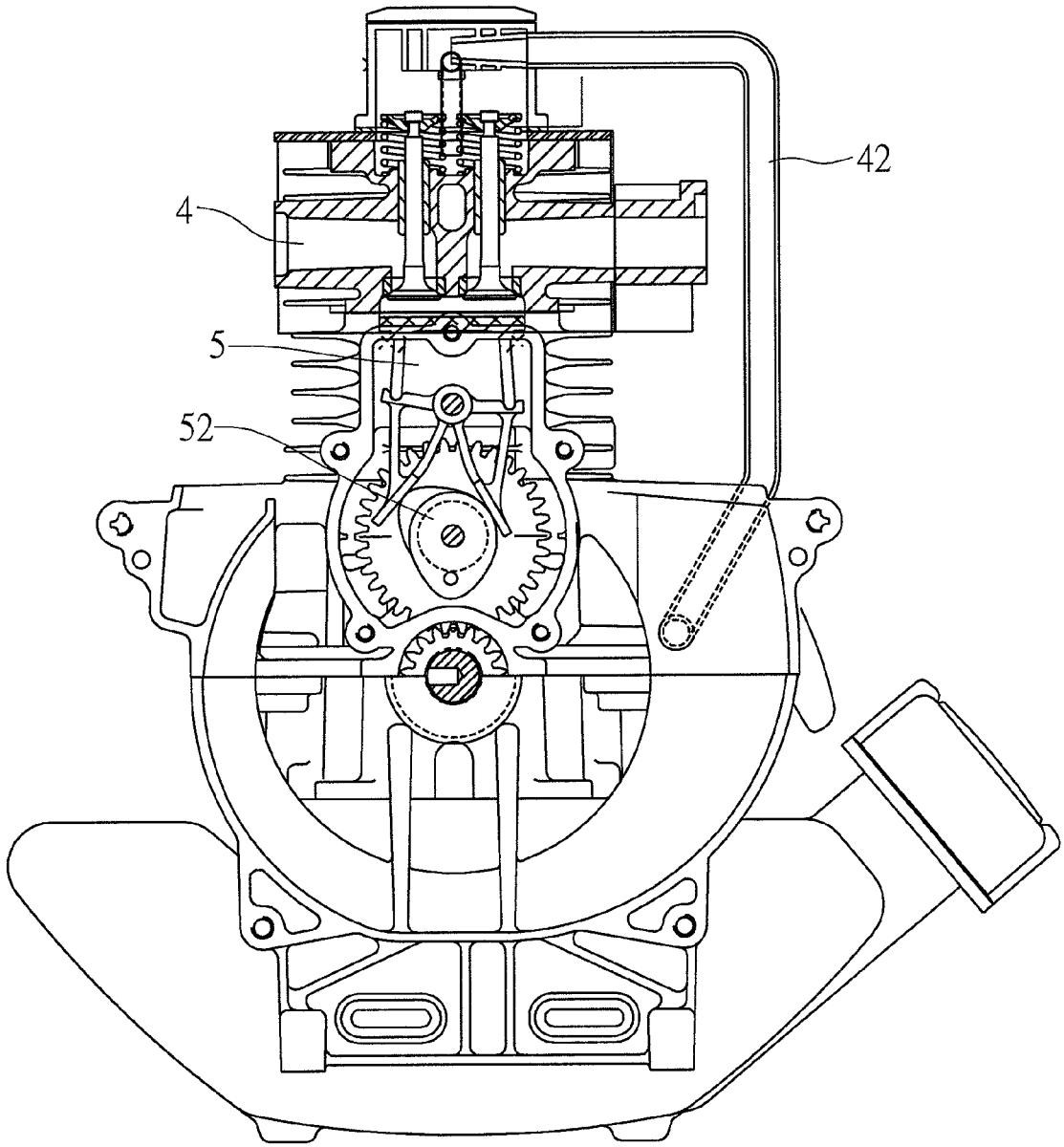

As shown in FIGS. 3A and 3B, the lubrication device of four-stroke engines of the present invention is applicable to four-stroke engines that at least have a cylinder 2, a crank case 3, a rocker arm room 4 and a cam room 5 that are connected to each other, and a breathing pipe 6, thereby enabling lubricant mist to be cycling from the crank case 3 through the rocker arm room 4 to the cam room 5, and then be absorbed back to the crank case 3, allowing the user to manipulate the engines at various angles. In the embodiment, the lubrication device is applied to, for instance, four-stroke engines of wet-sump design (i.e., the crank case is connected to the lubricant tank), but not limited to the scope of the present invention, the lubrication device of the present invention is applicable to any four-stroke engine that must integrate with lubrication device.

In the four-stroke engines of the embodiment, the crank case 3 has a crankshaft that is divided into a crankshaft first section 32 and a crankshaft second section 33 that are connected to each other via a connection part 31 and move simultaneously. The cylinder 2 comprises a piston connecting rod 21 connected to the connection part 31, and a piston 22 connected to a top end of the piston connecting rod 21. The rocker arm room 4 has a rocker arm 41, the cam room 5 is disposed with a cam 51 having a camshaft 52, and the rocker arm 41 is used for simultaneously activating the cam 51. In addition, the cam room 5 has a breathing pipe 6 connected to a air filter (not shown in the figures) for emitting exhaust fume. Since the principle of internal combustion of four-stroke engines is well understood by those in the industry and is not a creative feature of the present invention, descriptions of engine movement principles and detailed mechanism design will not be described in details herein.

The lubrication device of the present invention comprises: a lubricant tank 7 integrated to the underneath of the crank case 3, for containing lubricant 71; a stirring chamber 34 disposed beneath the crankshaft 3 and partially disposed inside the lubricant tank 7, and having at least one oil hole 342 connected to the lubricant tank 7; an oil stirring rod 23 disposed at bottom end of the piston connecting rod 21 and is set inside the stirring chamber 34, for string the lubricant 71 to form oil mists; an oil supply path comprising a pipeline 42 connected to the rocker arm room 4 and the crank case 3, and an oil supply channel 321 disposed inside the crankshaft first section 32 of the crank case 3 and correspondingly connected to the pipeline 42 and interior of the crank case 3, and when the crankshaft first section 32 is at a first rotation angle, the oil supply channel 321 opens to supply the oil mists through the rocker arm room 4 to the cam room 5; and an oil recycling path comprising an oil recycling channel 331 disposed inside the crankshaft second section 33 and correspondingly connected to the interiors of the cam room 5 and the crank case 3, and when the crankshaft second section 33 is at a second rotation angle, the oil recycling channel 331 opens to re-absorb the oil mists to the interior of the crank case 3.

In the embodiment, the stirring chamber 34 comprises a long and narrow concave 341 located inside the lubricant tank 7, wherein in addition to two sides and bottom end of the long and narrow concave 341, each of the oil holes 342 can also be formed on bottom of the stirring chamber 34 nearby the two sides of the long and narrow concave 341, thereby providing engines with proper oil dropping channel at various angles even in a upside down situation, as well as balancing pressure between the crank case 3 and the lubricant tank 7. Moreover, the crankshaft first section 32 and the crankshaft second section 33 are connected to each other via the connection part 31 and consequently move simultaneously. The basic principle of the said first rotation angle and the said second rotation angle is such that they alternate to each other, but there are no specific limitations. In the embodiment, the condition in which the first rotation angle and the second rotation angle alternate to each other at an angle of 180 degrees is used as an example, but not limited thereto.

Figure 4A:
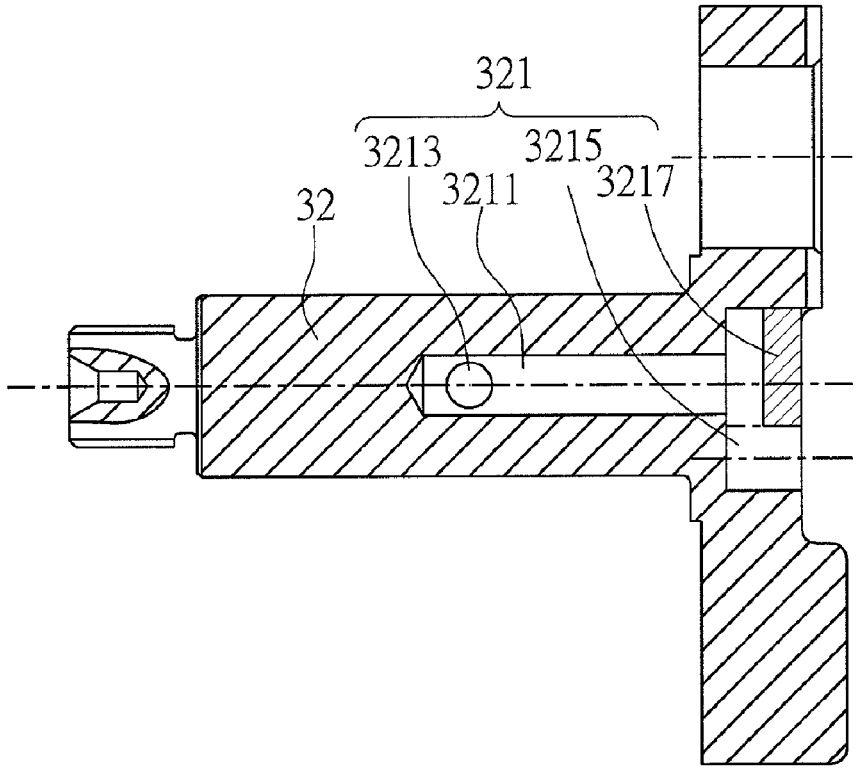
FIGS. 4A and 4B are a top view and a partial side view schematic diagram of a crankshaft first section of four-stroke engines on which the present invention, respectively.
Figure 4B:
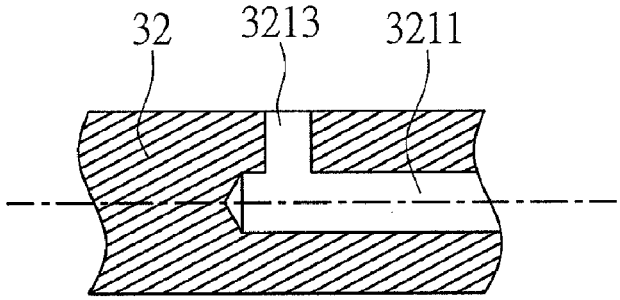
Figure 4C:
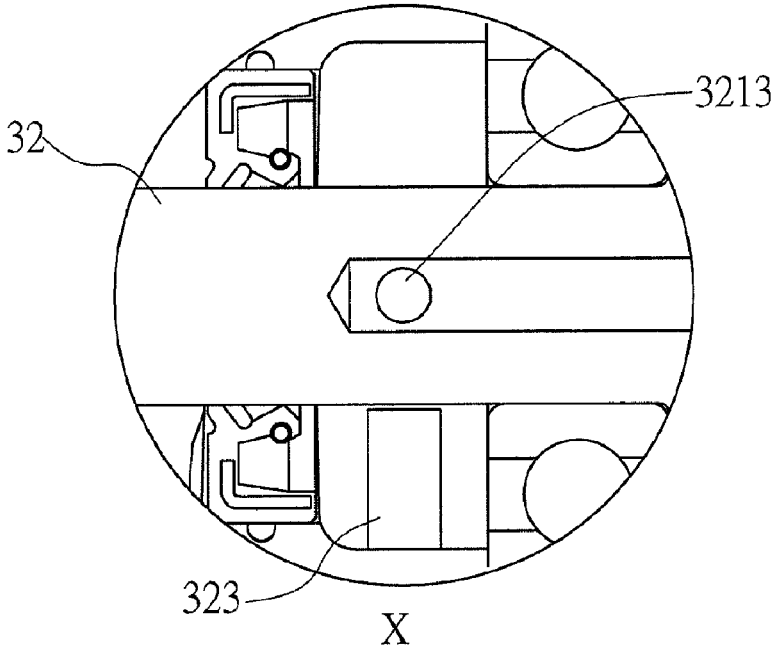
FIGS. 4C and 4D are an enlarged diagram of block X and a side view of a first obstruction block of the block X shown in FIG. 3A, respectively.
Figure 4D:
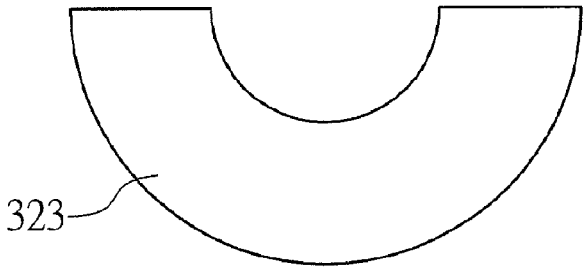

Referring to FIGS. 4A and 4B, the oil supply channel 321 is allocated inside the crankshaft first section 32. In the embodiment, the oil supply channel 321 comprises a first axial aperture 3211 connected to the interior of the crank case 3, and a first radial aperture 3213 connected to the first axial aperture 3211 and the pipeline 42. In addition, the oil supply channel 321 further comprises a first eccentric aperture 3215 connected to the first axial aperture 3211 and the interior of the crank case 3, and a first airtight oil plug 3217 disposed at an axle center of the crankshaft first section 32 corresponding to a rim of the first eccentric aperture 3215. Moreover, referring to FIGS. 4C and 4D, a first obstruction block 323 is disposed on external side of the crankshaft first section 32 corresponding to the first radial aperture 3213, the first obstruction block 323 is in the form of a half circular ring and is for covering area of the first radial aperture 3213 of the crankshaft first section 32 beyond the first rotation angle. One end of the foresaid pipeline 42 is connected to one side of the crank case 3 corresponding to the first radial aperture 3213, i.e., the space of opposite side of the first obstruction block 323, thereby connected to the first radial aperture 3213 via the space.

According to the above disclosed design of oil supply path, when the crankshaft first section 32 rotates, particles of oil drop are flung off via an end side of the crankshaft first section 32 by a centrifugal force, only allowing oil mists to pass through the oil supply channel 321. In other words, the first airtight oil plug 3217 mostly encloses the exterior of the axle center of the first axial aperture 3211, and therefore, the particles of oil drops can be flung off via end side of the crankshaft first section 32 by centrifugal force while rotating, and pressure difference enables the oil mists to travel only from the first eccentric aperture 3215 to the first axial aperture 3211. The foresaid first radial aperture 3213 and the first obstruction block 323 compose a supply switch that controls oil supply. In the embodiment, when the crankshaft first section 32 rotates to the first rotation angle (i.e., the first radial aperture 3213 is away from territory of the first obstruction block 323), and then based on the descending route of the piston 22, a positive pressure generated enables the oil mists to travel via the pipeline 42 passing the rocker arm room 4 to the cam room 5, thereby reaching object of oil mists transmission.

Figure 5A:
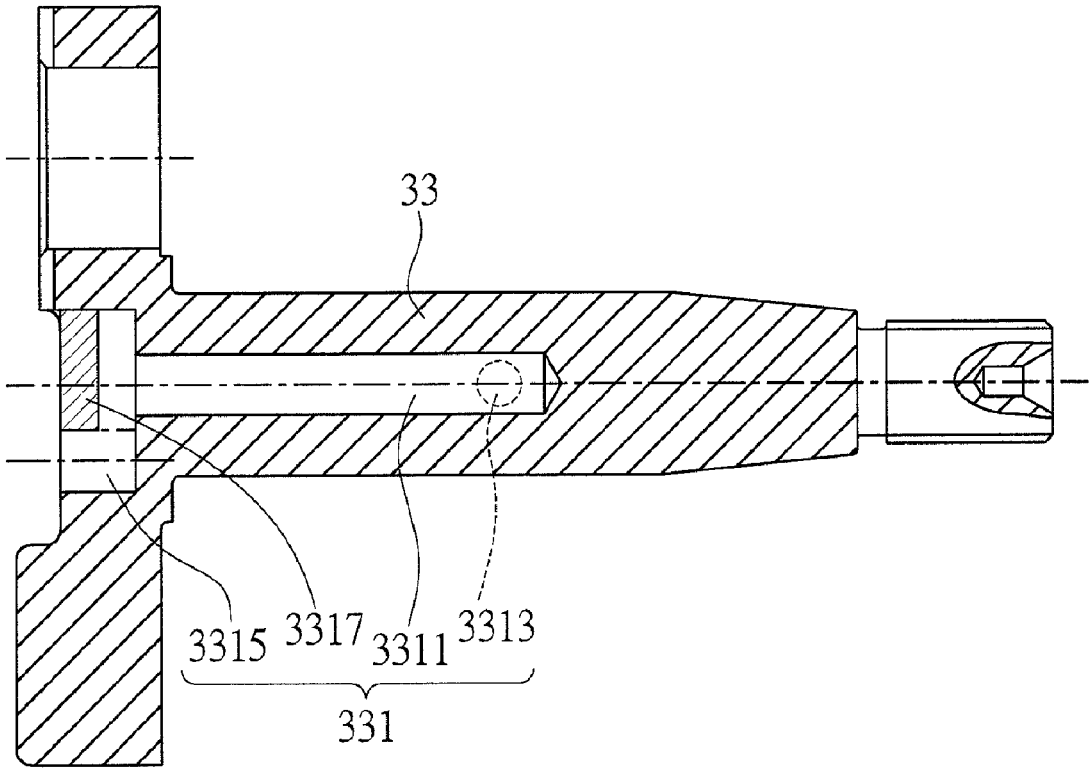
FIGS. 5A and 5B are a top view of a crankshaft second section and a partial side view of a four-stroke engine on which the present invention is applied.
Figure 5B:
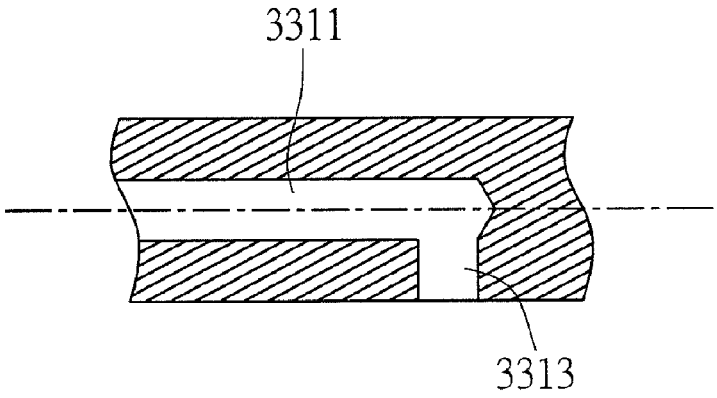
Figure 5C:
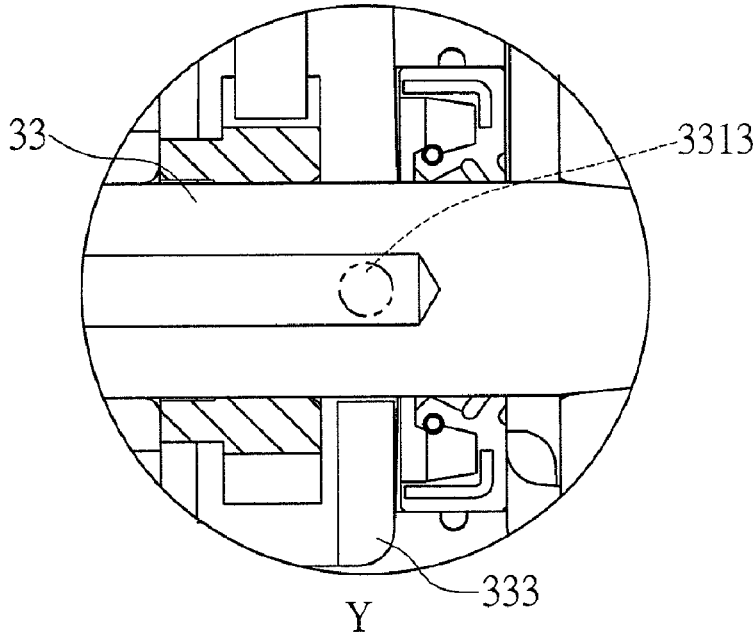
FIGS. 5C and 5D are an enlarged diagram of block Y and a side view of a second obstruction block of the block Y shown in FIG. 3A, respectively.
Figure 5D:
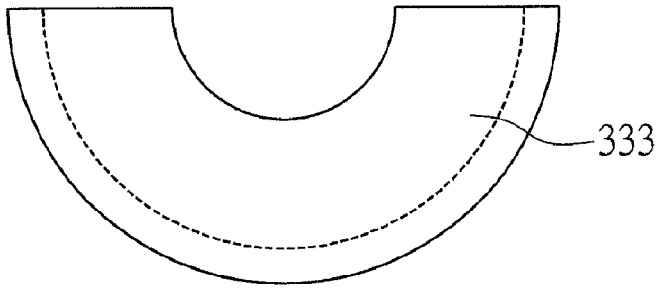

Referring to FIGS. 5A and 5B, the oil recycling channel 331 is disposed on crankshaft second section 33. In the embodiment, the oil recycling channel 331 comprises a second axial aperture 3311, connected to the interior of the crank case 3, and a second radial aperture 3313 connected to the second axial aperture 3311 and the cam room 5. In addition, the oil recycling channel 331 further comprises a second eccentric aperture 3315 connected to the second axial aperture 3311 and the interior of the crank case 3, and a second airtight oil plug 3317 disposed at the axle center of the crankshaft second section 33 corresponding to a rim of the second eccentric aperture 3315. Since the second airtight oil plug 3317 mostly encloses the exterior of the axle center of the second axial aperture 3311, the particles of oil drops can be flung off via an end side of the crankshaft second section 33 by a centrifugal force while rotating, a pressure difference accordingly prevents the lubricant from traveling to the second axial aperture 3311 via the second eccentric aperture 3315. Moreover, referring to FIGS. 5C and 5D, the crankshaft second section 33 is disposed with a second obstruction block 333, for instance, in the form of a half circular ring, corresponding to the second radial aperture 3313, and is for covering area of the second radial aperture 3313 of the crankshaft second section 33 beyond the second rotation angle.

According to the above disclosed design of oil recycling path, the second radial aperture 3313 and the second obstruction block 333 compose a re-absorption switch for controlling oil mists or oil drops. In the embodiment, when the crankshaft second section 33 rotates to the second rotation angle (i.e., the second radial aperture 3313 is away from territory of the second obstruction block 333), oil mists or oil drops can travel to the interior of the crank case 3 via the second radial aperture 3313 and the second axial aperture 3311. Based on the ascending route of the piston 22, a negative pressure generated inside the crank case 3 enables the oil mists to be re-absorbed and recycled. Furthermore, the second eccentric aperture 3315 is designed to employ a centrifugal force for preventing oil drops inside the stirring chamber 34 from reflowing into the second axial aperture 3311. It must be specifically stated herein that the condition in which the first rotation angle and the second rotation angle in the embodiment alternate to each other at an angle of 180 degrees is used as an example. In other words, when the crankshaft first section 32 rotates to the first rotation angle, the crankshaft second section 33 is at an angle 180 difference from the first rotation angle, and therefore, the oil supply channel 321 and the oil recycling channel 331 open alternately, but not at the same time.

Moreover, although the crankshaft of the crank case 3 in the embodiment comprises a crankshaft first section 32 and a crankshaft second section 33 connected to to each other via a connecting part 33 and moving simultaneously, it does not limit the scope of the present invention. The crankshaft may also be replaced with a single crankshaft, and of course, the single crankshaft may be divided into a first section, connection part, and a second section, and then form the foresaid oil supply channel 321 and oil recycling channel 331 on the first section and the second section, respectively, to achieve the same technique effect. Since disposal of a single piece crankshaft or two pieces fabricated crankshaft that move simultaneously inside crank case of engine is a conventional technique by the industry and not the creative feature of the present invention, no detailed descriptions are provided with reference to the figures.

Figure 6A:
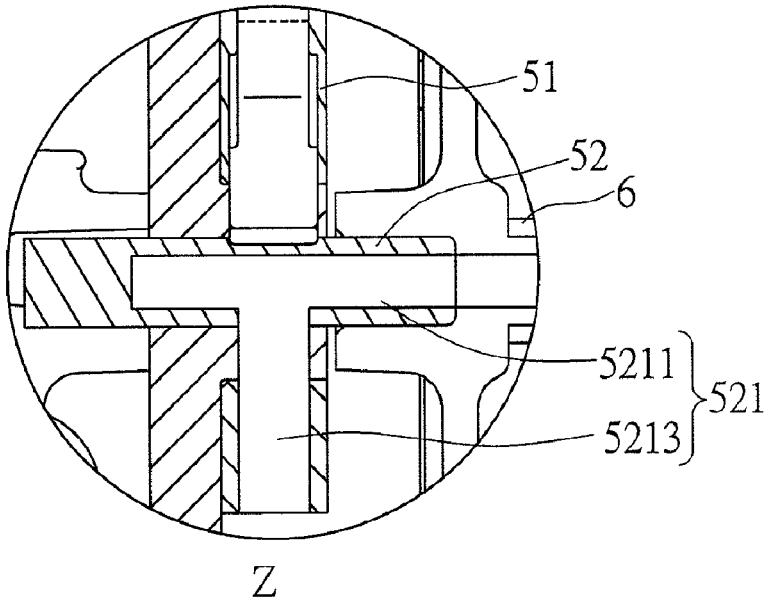
FIGS. 6A and 6B are a magnified diagram of block Z and a lateral view of cam and camshaft of the block Z of FIG. 3A, respectively.
Figure 6B:
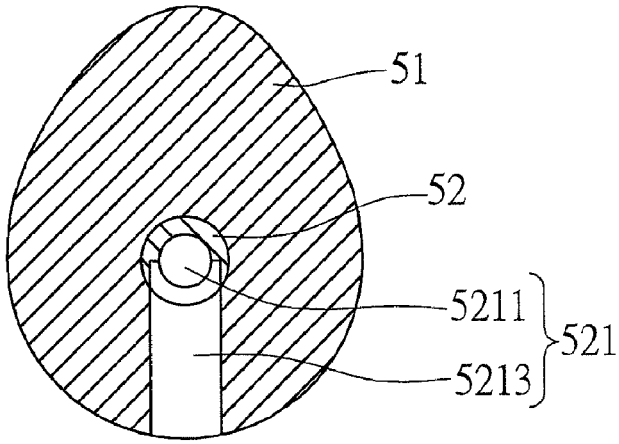

The cam room 5 has a cam 51 disposed therein, the cam 51 and a cam gear 53 are fixed on a camshaft 52, and the cam gear 53 is activated by a crankshaft gear 335 fixed on the crankshaft second section 33. Besides, the camshaft 52 is disposed with an exhaust channel 521 in order to connect the cam room 5 and the breathing pipe 6, and the breathing pipe 6 is for connecting to air filter (not shown in the figures). Referring to FIGS. 6A and 6B, in the embodiment, the exhaust channel 521 comprises a third axial aperture 5211 disposed on the camshaft 52 and is connected to the breathing pipe 6, and a third radial aperture 5213 connecting the third axial aperture 5211 and the cam room 5. Since the rotation of the cam 51 and the camshaft 52 enables the third radial aperture 5213 to create a fling, centrifugal force, neither particles of oil drops nor massive oil mists will travel through the exhaust channel into the air filter while engine is operating.

When the engine is operating in a level state, as shown in FIGS. 3A, 4A to 4D, and 5A to 5D, lubricant 71 is capable of entering into the crank case 3 through oil holes 342 located on bottom of the long and narrow concave 341 underneath the crank case 3, and when the crankshaft (including the crankshaft first section 32 and crankshaft second section 33) rotates, it simultaneously activates the oil stirring rod 23 at a bottom end of the piston connecting rod 21 to stir lubricant inside the long and narrow concave 341 so as to form oil drops and oil mists. The oil drops and oil mists may be dispensed evenly inside space of the crank case 3, and the oil holes on two sides of the long and narrow concave 341 are capable of balancing interior pressures of the crank case 3 and lubricant tank 7.

When the crankshaft (including the crankshaft first section 32 and crankshaft second section 33) rotates counterclockwise to the first rotation angle, it enables the piston connecting rod 21 to descend, and consequently the interior pressure of the crank case 3 begins to increase due to a reduced volume, thereby forcing oil mists inside the crank case 3 to travel into the oil supply channel 321 inside the crankshaft first section 32, and then through the first eccentric aperture 3215 and the first axial aperture 3211 to the first radial aperture 3213, at this moment, the relation between the first radial aperture 3213 and the first obstruction block 323 is in an opening state, the first obstruction block 323 is opposite to an opening space connected to the pipeline 42, therefore the oil mists are capable of traveling into the pipeline 42, and then the oil mists can travel to the rocker arm room 4 through the pipeline 42 to lubricate the rocker arm 41 and other components, as well as travel to the cam room 5 to lubricate the cam 51, cam gear 53, and crankshaft gear 335. The design of the third radial aperture 5213 of the exhaust channel 521 employs a centrifugal force to prevent massive oil mists from entering the air filter, and congealed liquid lubricant and oil mists are gathered underneath the cam room 5. At this moment, the relation between the second radial aperture 3313 of the crankshaft second section 33 and the second obstruction block 333 is in a closing state.

When the piston 22 of the cylinder 2 descends to a dead end, the piston 22 is back on an ascending route, and then the first radial aperture 3213 of the crankshaft first section 32 and the first obstruction block 323 is in a closing state, while the second radial aperture 3313 of the crankshaft second section 33 and the second obstruction block 333 is in an opening state, and then the interior pressure of the crank case 3 begins to decrease due to an expanded volume. Therefore, via the second radial aperture 3313 of the crankshaft second section 33 and then passing through the second axial aperture 3311 and the second eccentric aperture 3315, the gathered lubricant and oil mists underneath the cam room 5 are absorbed into the crank case 3, and a lubrication cycle is thus completed.

Figure 7:
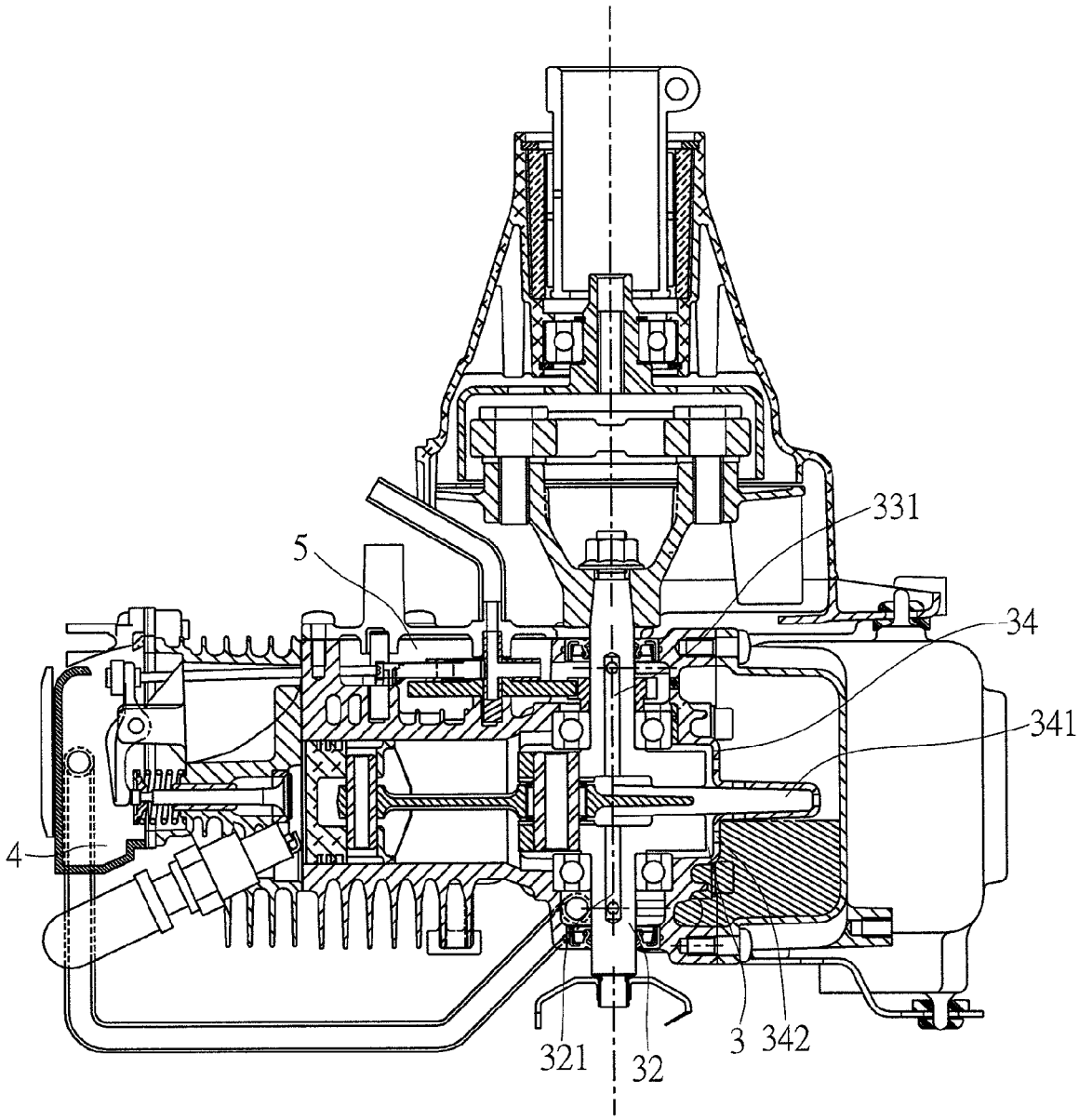
FIG. 7 is a schematic diagram illustrating an operating state of the lubrication device of four-stroke engines, turning at 90 degrees, of the present invention.

As shown in FIG. 7, when the engine is manipulated at a 90 degree angle, lubricant dispersion is affected by gravity, lubrication can be done by utilizing lubricant originally stored inside the long and narrow concave 341 of the crank case 3, and oil drops can be continuously provided to the crankshaft first section 32 via oil holes 342 on bottom of the stirring chamber 34 nearby two sides of the long and narrow concave 341, and then the oil drops are cracked into oil mists by rotating the crankshaft first section 32 for lubrication purpose to prevent excess lubricant from entering the rocker arm room 4, cam room 5, and air filter and consequent excessive lubrication or dead engine. The design of the oil supply channel 321, which employs centrifugal force as well as auto control over opening/closing, provides the lubrication device disclosed herein with the capability of allowing oil mists but not the oil drops of larger particles to pass through, thereby effectively avoiding excessive lubrication. Further, the design of the oil recycling channel 331 provides the lubrication device disclosed herein with the capability of separating lubricant received in the crank case 3 from re-absorbed lubricant received in the cam room 5.

Figure 8:
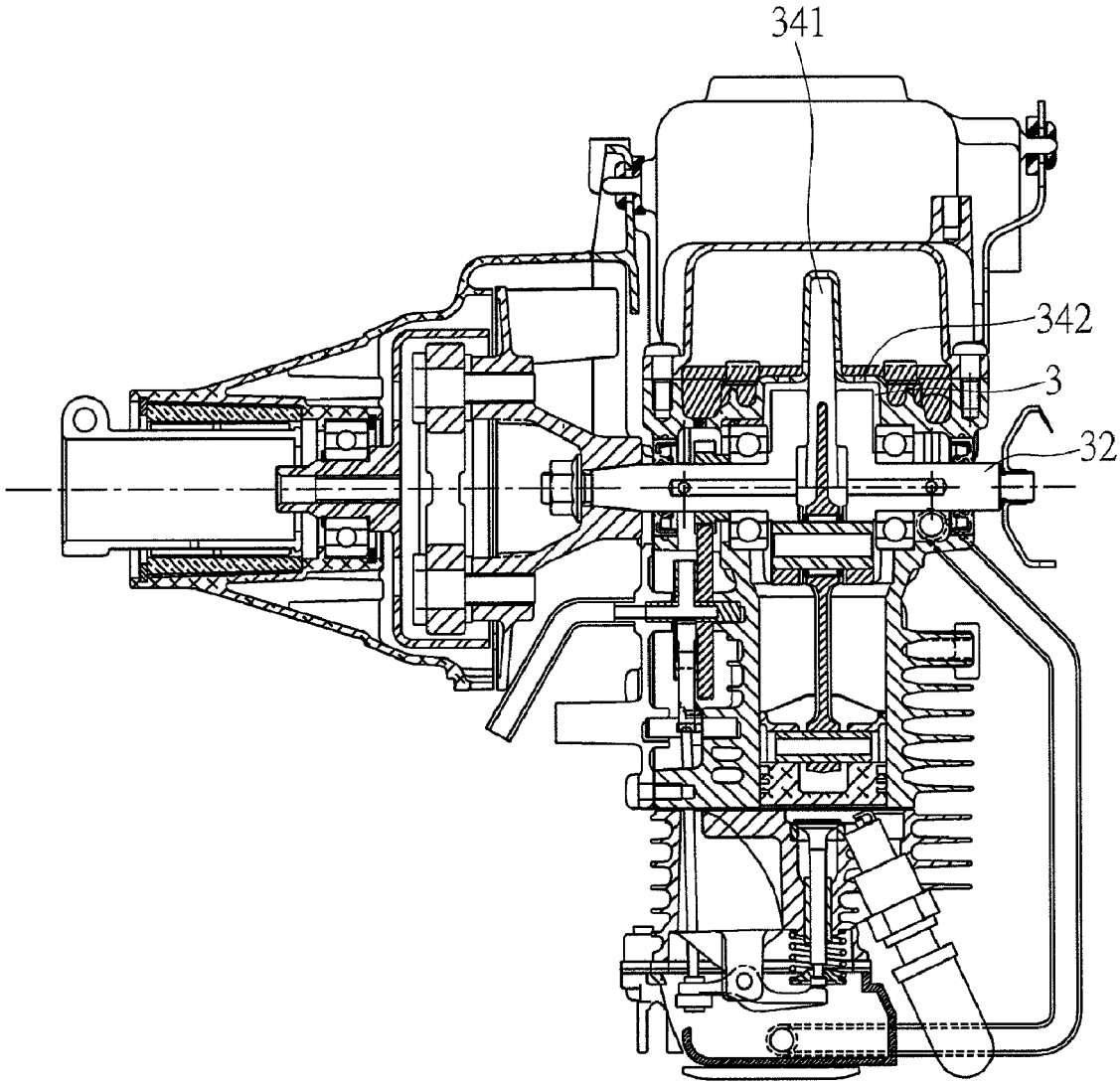
FIG. 8 is a schematic diagram illustrating an operating state of the lubrication device of four-stroke engines, tuning at 180 degrees, of the present invention.

As shown in FIG. 8, when the engine is manipulated at 180 degree angle, the lubrication principle and path are the same as when the foresaid engine turning at 90 degree. In both situation, lubrication may be done by utilizing lubricant originally stored inside the long and narrow concave 341 of the crank case 3, and oil drops can be continuously provided to the crankshaft first section 32 via oil holes 342 on bottom of the stirring chamber 34 nearby two sides of the long and narrow concave 341. Therefore, no detailed descriptions are provided herein. According to the above descriptions, the lubrication device of the present invention is capable of providing proper lubrication and allowing engines to be manipulated normally at various angles.

Figure 9:
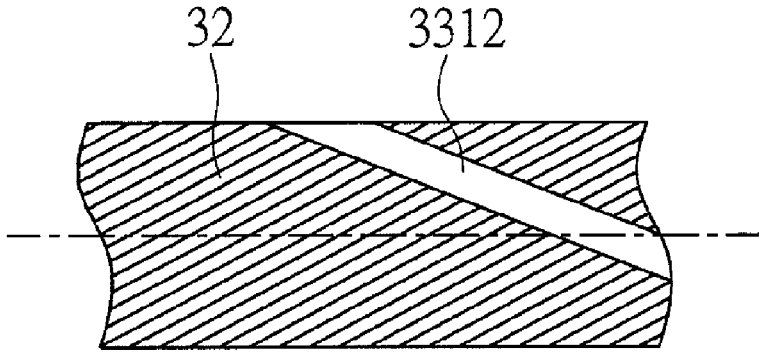
FIG. 9 is a side view schematic diagram of an oil supply channel of the lubrication device of four-stroke engines according to another embodiment of the present invention.
Figure 10:
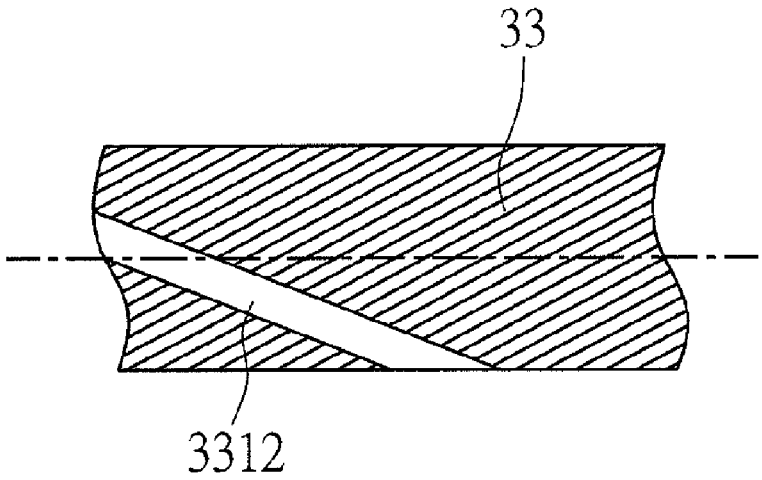
FIG. 10 is a side view schematic diagram of an oil recycling channel of the lubrication device of four-stroke engines according to another embodiment of the present invention.

In addition, although in the embodiment, the oil supply channel 321 mainly comprises a first axial aperture 3211 disposed on a crankshaft first section 32 and a first radial aperture 3213, and the oil recycling channel 331 mainly comprises a second axial aperture 3311 allocated on a crankshaft second section 33 and a second radial aperture 3313, but this example is not limit the scope of the present invention. For instance, as shown in FIG. 9, the first axial aperture 3211 and the first radial aperture 3213 of the crankshaft first section 32 can be replaced by a first slanting aperture 3212 having a first end and a second end. Of course, the first end is connected to the pipeline, and the second end is connected to interior of the crank case, and designs of the first eccentric aperture and the first obstruction block are the same as in the previous embodiment, thus no detailed descriptions are provided herein. Similarly, as shown in FIG. 10, the second axial aperture 3311 and the second radial aperture 3313 of the crankshaft second section 33 may be replaced by a second slanting aperture 3312 having a first end and a second end. Since the first end is connected to cam room, and the second end is connected to interior of crank case, and designs of the second eccentric aperture and the second obstruction block are also the same as in the previous embodiment, no detailed descriptions are provided herein.

Figure 11:
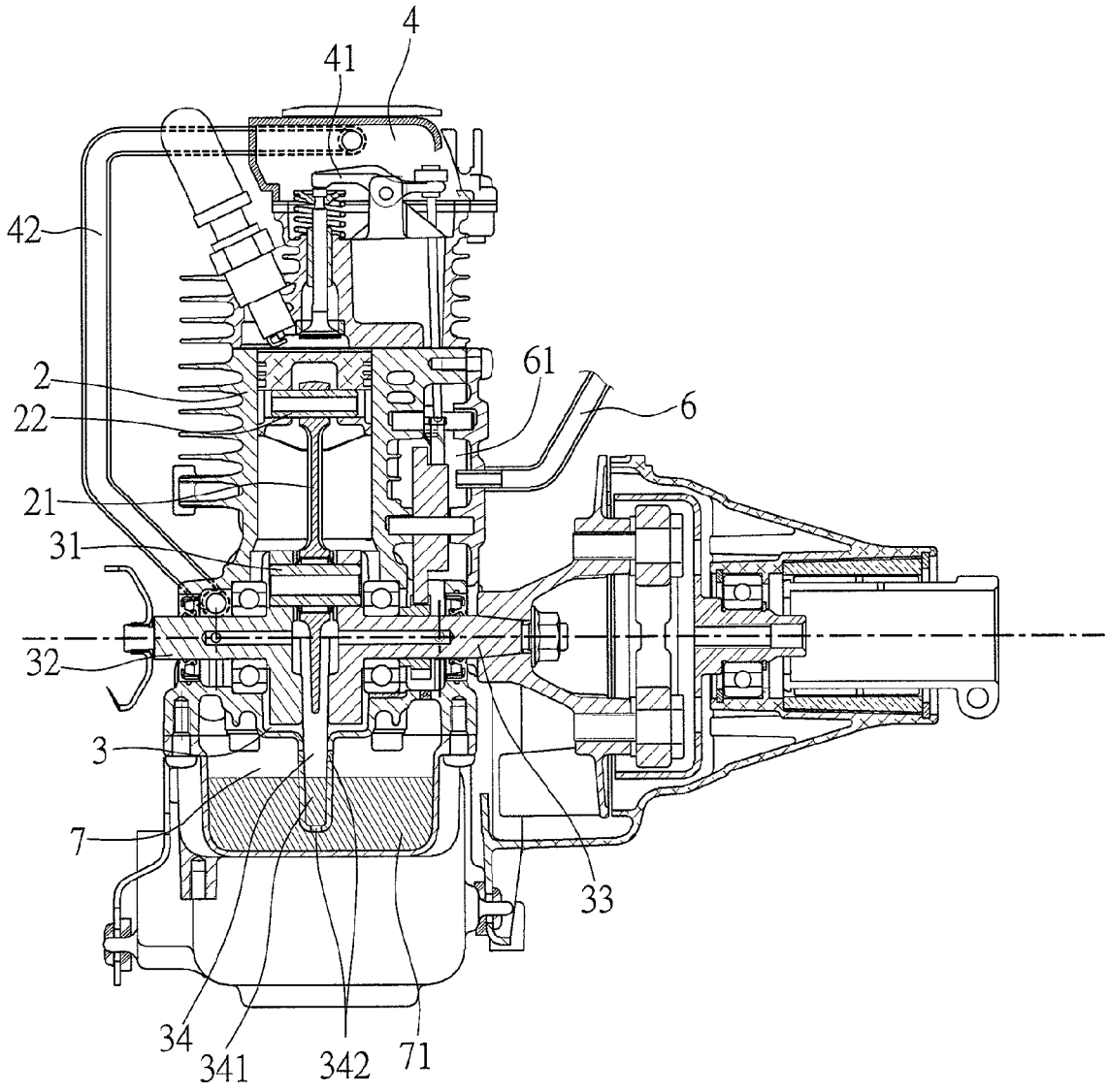
FIG. 11 is a top view of a breathing pipe in the lubrication device of four-stroke engines according to another embodiment of the present invention.
Figure 12:
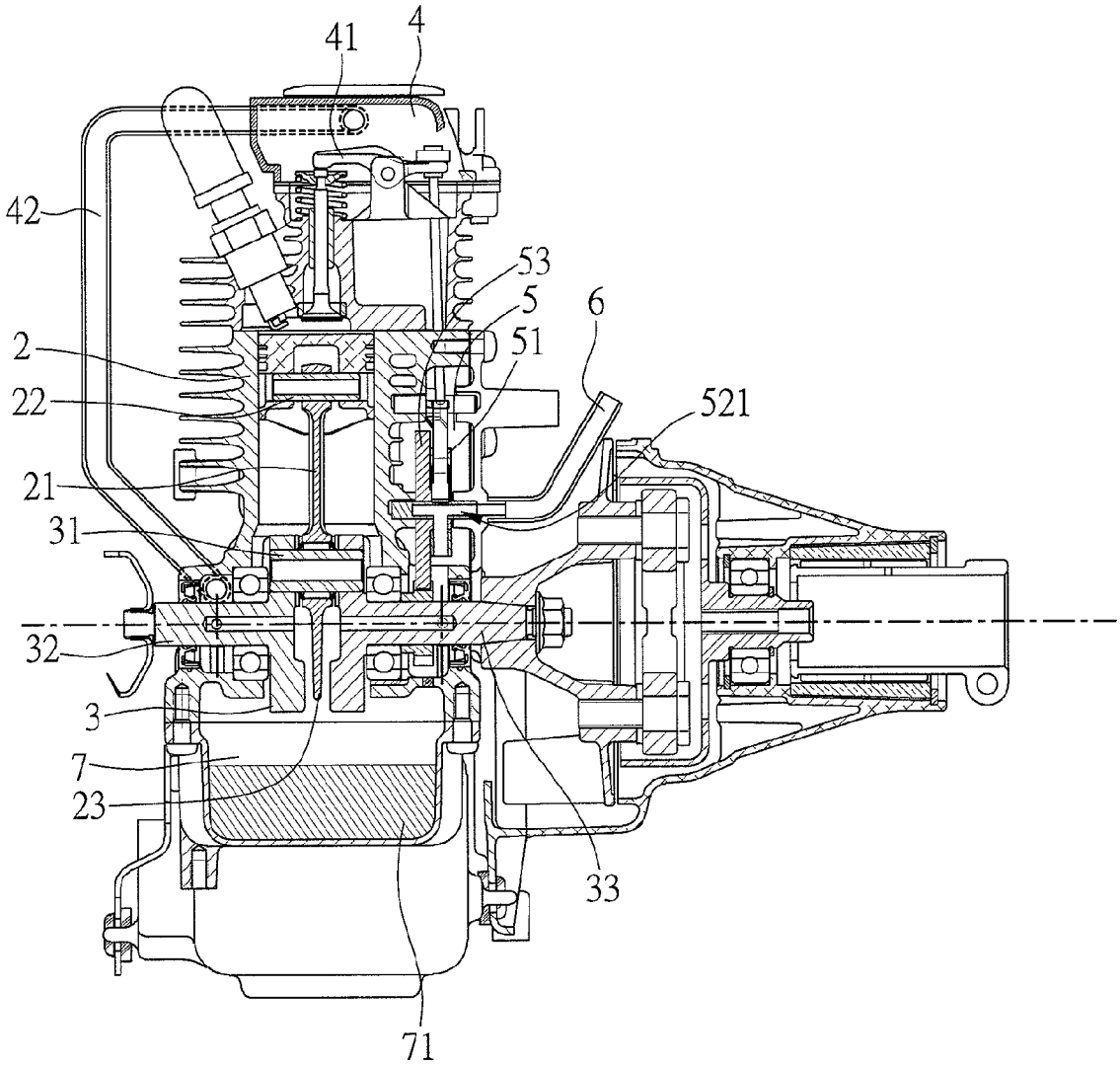
FIG. 12 is a top view of a lubrication device of four-stroke engines according to another embodiment of the present invention.

The exhaust channel 521 is disposed in the cam room 5 for avoiding problems, such as massive lubricant flowing out from the breathing pipe 6, and consequent massive lubricant consumption, air filter contamination and engine extinguished resulting from massive lubricant accumulated in the breathing pipe. For the sake of brevity, the foresaid feature is illustrated in the previous embodiment but not intended at limiting the positions of the exhaust channel 521 and the breathing pipe 6. The position of the breathing pipe 6 can be optionally designed in the four-stroke engine depending upon demand of practical application. As shown in FIG. 11, the breathing pipe 6 is connected to a room space, which is not the space in the cam room 5 shown in FIG. 3A, in the four-stroke engine. Specifically, the breathing pipe 6 is connected to the channel 61 between the cylinder 2 and the crank case 3. The remaining designs in FIG. 11 are similar to those in FIG. 3A. Since the breathing pipe 6 is not hermetically connected to the camshaft 52, there is no fling centrifugal force generated from the rotation of the cam 51 and the camshaft 52. Therefore, this embodiment can be used in the engine generating fine oil drops or little oil mists during non-long term of manipulation, such that air smoothly flows into the channel 61 and lubricant is prevented from flowing out of the breathing pipe 6. In addition, in this embodiment, the lubrication device of the four-stroke engine can be designed without the oil supply channel 321 and the oil recycling channel 331 (i.e., only the exhaust channel 521 is designed instead in the lubrication device). FIG. 12 shows another embodiment of a lubrication device of a four-stroke engine in the present invention. The four-stroke engine includes a cylinder 2, a crank case 3 a rocker arm room 4 and a cam room 5 that are connected to each other, and a breathing pipe 6, thereby enabling lubricant mist to be cycling from the crank case 3 through the rocker arm room 4 to the cam room 5 and then be absorbed back to the crank case 3, allowing the user to manipulate the engines at various angles. This embodiment differs from that shown in FIG. 3A in that the lubricant tank 7 and the stirring chamber 34 are integrally formed. That is, the lubricant tank 7 is not hermetical, such that lubricant is not isolated in the stirring chamber 34. Also, the oil stirring rod 23 is directly formed on one end of the piston connecting rod 21 corresponding to the lubricant tank 7 for directly stirring the lubricant to oil mists. Thus, this embodiment is suitable for machines manipulated at smaller angles such as lawn mowers. The designs of the oil supply channel, oil recycling channel, eccentric aperture and airtight oil plug are similar to those in the foresaid embodiments, and no detailed descriptions are provided herein. In this embodiment, the breathing pipe 6 is disposed in the cam room 5. Alternatively, the breathing pipe 6 can be disposed in the space connecting the cam room 5 and the rocker arm room 4, or disposed in the channel 61 between the cylinder 2 and the crank case 3.

In addition, in this embodiment, the lubrication device of the four-stroke engine can be designed without the oil supply channel 321 and the oil recycling channel 331 (i.e., only the exhaust channel 521 is designed instead in the lubrication device).

In view of the above, the lubrication device of four-stroke engines of the present invention mainly has the rocker arm room and the crank case connected to each other, and the design of alternating oil supply and oil-absorption channels enables lubricant mists to cycle from the crank case through the rocker arm room to cam room, and then to be re-absorbed into the crank case, thereby allowing engine to be manipulated at various angles. The design of the oil supply path and the oil recycling path provides proper lubrication, and based on the design of eccentric apertures and airtight oil plugs, situation of excess lubricant flowing out of the crank case can be avoided. in Moreover, the design of the exhaust channel employs centrifugal force to prevent oil drops or massive oil mists from entering, thereby avoiding problems of excessive lubricant consumption and air filter contamination caused by massive lubricant flowing out through the breathing pipe. Therefore, the lubrication device of four-stroke engines provided by the present invention overcomes various drawbacks of the prior art, and has industrial applicability, novelty, and non-obviousness.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A lubrication device of a four-stroke engine having a cylinder, a crank case, a rocker arm room connected to a cam room and a breathing pipe, the crank case comprising a crankshaft first section and a crankshaft second section connected to each other via a connection portion and move simultaneously, the cylinder having a piston connecting rod connected to the connection part, the lubrication device comprising:

a lubricant tank connected to a bottom of the crank case, for containing lubricant;

a stirring chamber disposed beneath the crank case and partially disposed inside the lubricant tank, and the stirring chamber having a long, narrow concave disposed in the lubrication tank and being disposed with at least one oil hole connected to the lubricant tank, each of the oil holes is at least disposed on two sides and a bottom end of the long, narrow concave;

an oil stirring rod disposed at one end of the piston connecting rod and received in the stirring chamber, for stirring the lubricant to form oil mists;

an oil supply path comprising a pipeline connected to the rocker arm room and the crank case, and an oil supply channel disposed inside the crankshaft first section and correspondingly connected to the pipeline and an interior of the crank case, and the oil supply channel being open when the crankshaft first section rotates to a first rotation angle in the crankshaft first section, so as to supply the oil mists through the rocker arm room to the cam room;

an oil recycling path comprising an oil recycling channel disposed inside the crankshaft second section and correspondingly connected to interiors of the cam room and the crank case, and the oil recycling channel being open when the crankshaft second section rotates to a second rotation angle different from the first rotation angle in the crankshaft second section, so as to re-absorb the oil mists into the crank case; and an exhaust channel comprising a third axial aperture disposed on the camshaft and connected to the breathing pipe, and a third radial aperture connected to the third axial aperture and the cam room.

2. The lubrication device of a four-stroke engine of claim 1, wherein each of the oil holes is further disposed on a bottom of the stirring chamber and adjacent to the two sides of the long, narrow concave.

3. The lubrication device of a four-stroke engine of claim 1, wherein the first rotation angle and the second rotation angle alternate to each other at 180 degrees.

4. The lubrication device of a four-stroke engine of claim 1, wherein the oil supply channel comprises a first axial aperture connected to the interior of the crank case, a first radial aperture connected to the first axial aperture and the pipeline, a first eccentric aperture connected to the first axial aperture and the interior of the crank case, and a first airtight oil plug disposed at an axle center of the crankshaft first section corresponding to a rim of the first eccentric aperture.

5. The lubrication device of a four-stroke engine of claim 4, wherein a first obstruction block is disposed on an external side of the crankshaft first section and corresponding to the first radial aperture, for covering an area beyond the first rotation angle.

6. The lubrication device of a four-stroke engine of claim 1, wherein the oil recycling channel comprises a second axial aperture connected to the interior of the crank case, a second radial aperture connected to the second axial aperture and the cam room, a second eccentric aperture connected to the second axial aperture and the interior of the crank case, and a second airtight oil plug disposed at an axle center of the crankshaft second section corresponding to a rim of the second eccentric aperture.

7. The lubrication device of a four-stroke engine of claim 6, wherein a second obstruction block is disposed on an external side of the crankshaft second section corresponding to the second radial aperture, for covering an area beyond the second rotation angle.

8. The lubrication device of a four-stroke engine of claim 1, wherein the oil supply channel comprises a first slanting aperture having a first end connected to the pipeline, and a second end connected to interior of the crank case.

9. A lubrication device of a four-stroke engine having a cylinder, a crank case, a rocker arm room connected to a cam room, the crank case having a crankshaft being divided into a first crank section, a connection part and a second crank section, and the cylinder having a piston connecting rod connected to a connection part, the lubrication device comprising:

a lubricant tank connected to a bottom of the crank case, for containing lubricant;

an oil stirring rod disposed at one end of the piston connecting rod corresponding to the lubricant tank, for stirring the lubricant to oil mists;

an oil supply path comprising a pipeline connected to the rocker arm room and the crank case, and an oil supply channel disposed inside the crankshaft first section and correspondingly connected to the pipeline and an interior of the crank case, the oil supply channel being open when the crankshaft first section rotates to a first rotation angle in the crankshaft first section, so as to supply the oil mists through the rocker arm room to the cam room; and an oil recycling path comprising an oil recycling channel disposed inside the crankshaft second section and correspondingly connected to interiors of the cam room and the crank case, the oil recycling channel being open when the crankshaft second section rotates to a second rotation angle different from the first rotation angle in the crankshaft second section, so as to re-absorb the oil mists into the crank case.

10. The lubrication device of a four-stroke engine of claim 9, wherein the cam room further comprises a breathing pipe, the crank room is disposed with a cam having a camshaft, and the lubrication device further comprises an exhaust channel having a third axial aperture disposed on the camshaft and connected to the breathing pipe, and a third radial aperture connected to the third axial aperture and the cam room.

11. The lubrication device of a four-stroke engine of claim 10, wherein the third radial aperture is perpendicular to the third axial aperture.

12. The lubrication device of a four-stroke: engine of claim 10, wherein the camshaft is connected to the breathing pipe.

13. The lubrication device of a four-stroke engine of claim 9, wherein the breathing pipe is disposed in a space underneath the rocker arm room, and wherein the space is a path between the cylinder and the crank case.

14. The lubrication device of a four-stroke engine of claim 9, wherein the first rotation angle and the second rotation angle alternate to each other at 180 degrees.

15. The lubrication device of a four-stroke engine of claim 9, wherein the oil supply channel comprises a first axial aperture connected to the interior of the crank case, a first radial aperture connected to the first axial aperture and the pipeline, a first eccentric aperture connected to the first axial aperture and the interior of the crank case, and a first airtight oil plug disposed at an axle center of the crankshaft first section corresponding to a rim of the first eccentric aperture.

16. The lubrication device of a four-stroke engine of claim 15, wherein a first obstruction block is disposed on an external side of the crankshaft first section and corresponding to the first radial aperture, for covering an area beyond the first rotation angle.

17. The lubrication device of a four-stroke engine of claim 9, wherein the oil recycling channel comprises a second axial aperture connected to the interior of the crank case, a second radial aperture connected to the second axial aperture and the cam room, a second eccentric aperture connected to the second axial aperture and the interior of the crank case, and a second airtight oil plug disposed at an axle center of the crankshaft second section corresponding to a rim of the second eccentric aperture.

18. The lubrication device of a four-stroke engine of claim 17, wherein a second obstruction block is disposed on an external side of the crankshaft second section corresponding to the second radial aperture, for covering an area beyond the second rotation angle.

19. The lubrication device of a four-stroke engine of claim 17, wherein the oil supply channel comprises a first slanting aperture having a first end connected to the pipeline, and a second end connected to interior of the crank case.

20. A lubrication device of a four-stroke engine having a cylinder, a crank case, a rocker arm room connected to a cam room and a breathing pipe, the crank case having a crankshaft first section and a crankshaft second section connected to each other via a connection portion and move simultaneously, the cylinder having a piston connecting rod connected to a connection part, the lubrication device comprising:

a lubricant tank connected to a bottom of the crank case, for containing lubricant;

a stirring chamber disposed beneath the crank case and partially disposed inside the lubricant tank, and the stirring chamber being disposed with at least one oil hole connected to the lubricant tank;

an oil stirring rod disposed at one end of the piston connecting rod and received in the stirring chamber, for stirring the lubricant to oil mists;

an oil supply path comprising a pipeline connected to the rocker arm room and the crank case, and an oil supply channel disposed inside the crankshaft first section and correspondingly connected to the pipeline and an interior of the crank case, the oil supply channel being open when the crankshaft first section rotates to a first rotation angle in the crankshaft first section, so as to supply the oil mists through the rocker arm room to the cam room; and an oil recycling path comprising an oil recycling channel disposed inside the crankshaft second section and correspondingly connected to interiors of the cam room and the crank case, the oil recycling channel being open when the crankshaft second section rotates to a second rotation angle different from the first rotation angle in the crankshaft second section, so as to re-absorb the oil mists into the crank case, wherein the breathing pipe is connected to a space inside the four-stroke engine.

21. The lubrication device of a four-stroke engine of claim 20, wherein the four-stroke engine further comprises the breathing pipe, and the breathing pipe further comprises a crank having a camshaft, and the lubrication device further comprises an exhaust channel comprising a third axial aperture disposed on the camshaft and connected to the breathing pipe, and a third radial aperture connected to the third axial aperture and the cam room.

22. The lubrication device of a four-stroke engine of claim 20, wherein the space is a path between the cylinder and the crank case.

23. The lubrication device of a four-stroke engine of claim 20, wherein the stirring chamber comprises a long, narrow concave disposed in the lubrication tank, and each of the oil holes is at least disposed on two sides and a bottom end of the long, narrow concave.

24. The lubrication device of a four-stroke engine of claim 20, wherein each of the oil holes is further disposed on a bottom of the stirring chamber and adjacent to the two sides of the long, narrow concave.

25. The lubrication device of a four-stroke engine of claim 20, wherein the first rotation angle and the second rotation angle alternate to each other at 180 degrees.

26. The lubrication device of a four-stroke engine of claim 20, wherein the oil supply channel comprises a first axial aperture connected to the interior of the crank case, a first radial aperture connected to the first axial aperture and the pipeline, a first eccentric aperture connected to the first axial aperture and the interior of the crank case, and a first airtight oil plug disposed at an axle center of the crankshaft first section corresponding to a rim of the first eccentric aperture.

27. The lubrication device of a four-stroke engine of claim 26, wherein a first obstruction block is disposed on an external side of the crankshaft first section and corresponding to the first radial aperture, for covering an area beyond the first rotation angle.

28. The lubrication device of a four-stroke engine of claim 20, wherein the oil recycling channel comprises a second axial aperture connected to the interior of the crank case, a second radial aperture connected to the second axial aperture and the cam room, a second eccentric aperture connected to the second axial aperture and the interior of the crank case, and a second airtight oil plug disposed at an axle center of the crankshaft second section corresponding to a rim of the second eccentric aperture.

29. The lubrication device of a four-stroke engine of claim 28, wherein a second obstruction block is disposed on an external side of the crankshaft second section corresponding to the second radial aperture, for covering an area beyond the second rotation angle.

30. The lubrication device of a four-stroke engine of claim 20, wherein the oil supply channel comprises a first slanting aperture having a first end connected to the pipeline, and a second end connected to interior of the crank case.

* * * * *